US012557891B2

(12) United States Patent
Green et al.

(10) Patent No.: US 12,557,891 B2
(45) Date of Patent: Feb. 24, 2026

(54) HAIR REMOVAL DEVICE

(71) Applicant: Anthony Green, Manila (PH)

(72) Inventors: Anthony Green, Manila (PH); Marc W. Holliday, Newcastle-Upon-Tyne (GB); Matthew J. Hulbert, Newcastle-Upon-Tyne (GB)

(73) Assignee: Anthony Green, Manila (PH)

( * ) Notice: Subject to any disclaimer, the term of this patent is extended or adjusted under 35 U.S.C. 154(b) by 132 days.

(21) Appl. No.: 18/220,458

(22) Filed: Jul. 11, 2023

(65) Prior Publication Data

US 2024/0008620 A1 Jan. 11, 2024

Related U.S. Application Data

(60) Provisional application No. 63/388,010, filed on Jul. 11, 2022.

(51) Int. Cl.
*A45D 27/44* (2006.01)
*A45D 26/00* (2006.01)

(52) U.S. Cl.
CPC ..... *A45D 27/44* (2013.01); *A45D 26/00* (2013.01); *A45D 2026/008* (2013.01)

(58) Field of Classification Search
CPC ..... A45D 27/02; A45D 27/04; A45D 27/44; A45D 26/00; A45D 26/0004; A45D 2026/008
See application file for complete search history.

(56) References Cited

U.S. PATENT DOCUMENTS

| | | | |
|---|---|---|---|
| 2,233,811 | A | 3/1941 | Doty |
| 4,845,845 | A | 7/1989 | Scott |
| 6,691,415 | B2 | 2/2004 | Quals |
| 8,157,814 | B2 | 4/2012 | Kelsey |
| 8,458,909 | B2 | 6/2013 | Hawes |
| 9,795,201 | B2 | 10/2017 | Barraclough |
| 2007/0180703 | A1 | 8/2007 | Sierra |

(Continued)

FOREIGN PATENT DOCUMENTS

| | | |
|---|---|---|
| WO | 2007/072040 | 6/2007 |

OTHER PUBLICATIONS 3 in 1 Painless Hair Removal Depilatory Cream Repair Lotion Scraper, Boggle Up, 2017 (18 pages).

(Continued)

*Primary Examiner* — Todd J Scherbel
(74) *Attorney, Agent, or Firm* — Fleit Intellectual Property Law; Paul D. Bianco

(57) ABSTRACT

A hair removal tool or device for removing depilatory cream from any part of the body typically where unwanted hair grows, including without limitation the face, legs, underarms, arms, intimate areas, chest and back. The device can also be used to apply or more uniformly spread the depilatory cream to make the cream more effective prior to removal. The device can also be used for applying and removing other skin treatment lotions such as an exfoliating lotion. The hair removal device includes a scraper portion having an edge for removing hair from skin as the edge moves along the skin and scrapes the depilatory cream; and a receptacle portion coupled to the scraper portion and having a receptacle for collecting the scraped depilatory cream and removed hair.

14 Claims, 9 Drawing Sheets

(56) References Cited

U.S. PATENT DOCUMENTS

| | | | | |
|---|---|---|---|---|
| 2007/0215590 | A1* | 9/2007 | Barraclough | A45D 26/00 219/223 |
| 2009/0159469 | A1* | 6/2009 | Russell | B26B 21/40 206/352 |
| 2012/0276176 | A1 | 11/2012 | Smith | |
| 2014/0238433 | A1 | 8/2014 | Jackson | |
| 2020/0238549 | A1* | 7/2020 | Abramsky | A45D 27/00 |

OTHER PUBLICATIONS

30Pcs Hair Wax Cleansing Spatulas Mask Scraper Plastic Makeup Sticks Depilatory Creams Hair Waxing Removal Beauty Tools (White and Pink), first available per Amazon published Apr. 27, 2020 (3 pages).

Beauty tools scraper hair removal cream PP plastic scraper plate mask scraper, Shopee Malaysia; 2021 (2 pages).

The SAEM Body & Soul Hair Removal Cream (With Free Scraper) 80ml—LMCHING Group; 2021 (5 pages).

Ziaja Depilatory Cream—(https://nicolish.files.wordpress.com/2015/04/naamloos-42.png) Nicolish; 2015 (5 pages).

* cited by examiner

FIG. 9
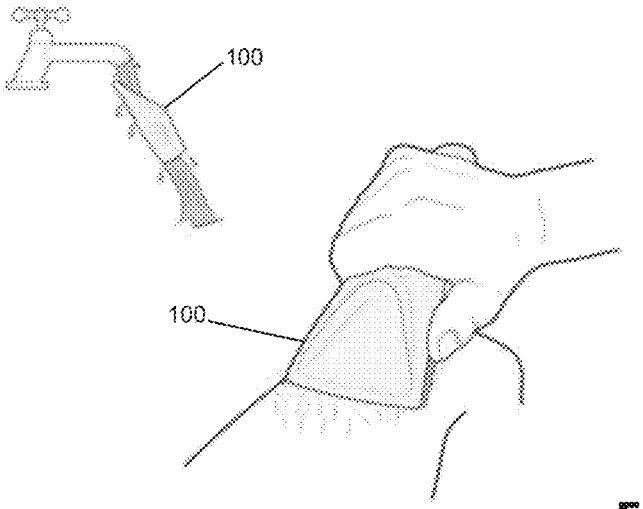
FIG. 11
FIG. 12
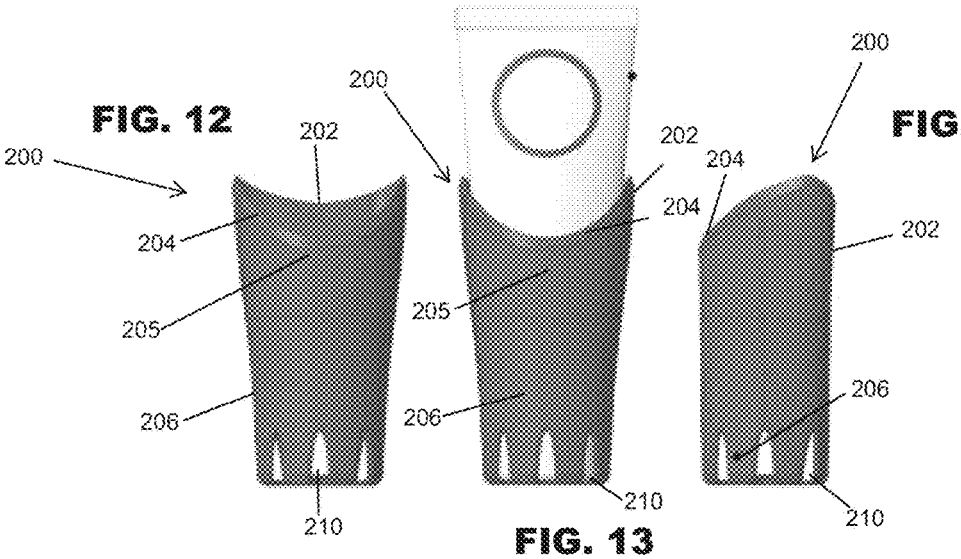
FIG. 14
FIG. 13
FIG. 15
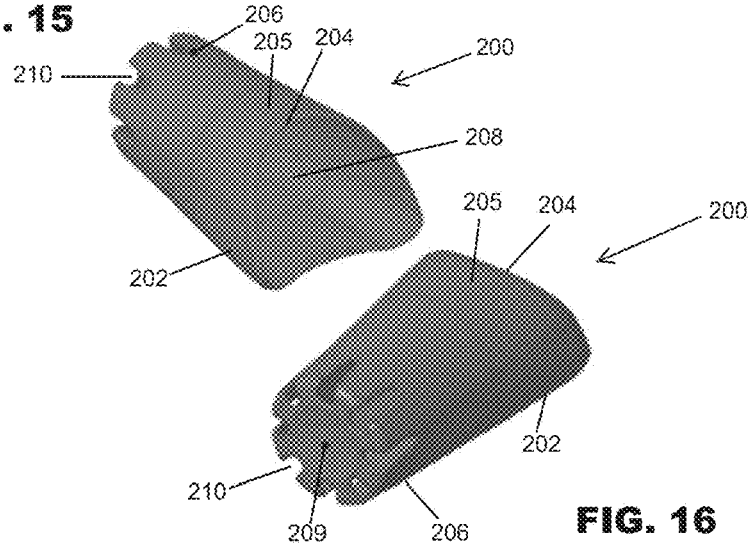
FIG. 16

HAIR REMOVAL DEVICE

FIELD OF THE DISCLOSURE

The disclosure relates to a hair removal tool or device for use with a depilatory cream for removing unwanted hair.

BACKGROUND

In a depilatory method, a preparation (referred to herein generically as a cream) is applied to the skin, in order to degrade the hair growing from the skin. The cream and hair may be removed without any mechanical assistance, for example by showering. This method is less abrasive to the skin but tends to be imperfect with respect to hair removal.

An alternative method is to remove the cream and hair by means of a spatula, used in the manner of a scraper or strigil. The scraping action of the spatula helps to remove those hairs which have been incompletely degraded by the cream. Thus, hair removal is very effective. However, the user has to continually wipe collected cream and hair off a scraper blade and onto a tissue. In addition to being time consuming and messy, this alternative method increases exposure to the chemicals found in depilatory creams (e.g. thioglycolic acid), which can cause eye damage and skin irritation.

Therefore, there exists a need for an improved hair removal device.

SUMMARY OF THE DISCLOSURE

According to the disclosure, the hair removal device for use with a depilatory cream comprises a scraper portion having an edge for removing hair from skin as the edge moves along the skin and scrapes the depilatory cream; and a receptacle portion coupled to the scraper portion and having a receptacle for collecting the scraped depilatory cream and removed hair.

In an embodiment, the receptacle portion is removably coupled to the scraper portion. In an exemplary embodiment, the receptacle includes a rim on which a bottom of the scraper portion rests when the scraper portion is inserted into the receptacle portion.

The receptacle portion can include flush vents so that the collected depilatory cream and removed hair can be rinsed from the receptacle portion.

In an embodiment, the scraper portion includes a secondary edge configured and dimensioned to conform to facial contours and where in the edge is configured and dimensioned to conform to arm and/or leg contours. In an exemplary embodiment, the scraper portion includes a top section with the secondary edge and a front portion with the edge. The secondary edge can be convex and the edge can be concave.

In some embodiments, a back surface of the device includes an exfoliator feature. Non-limiting examples of the exfoliator feature include a plurality of bumps.

Another hair removal device for use with a depilatory cream disclosed herein comprises an elongate body with an outer surface forming a plurality of scraper portions. Each of the plurality has an edge for removing hair from skin as the edge moves along the skin and scrapes the depilatory cream. The outer surface is a series of curved surfaces including a first convex curve transitioning to a first concave curve transitioning to a second convex curve transitioning to a second concave curve transitioning to a tip portion. A curvature of the first convex curve is larger than a curvature of the second convex curve and a curvature of the first concave curve is smaller than a curvature of the second concave curve.

The elongate body can have a central portion that is transparent or translucent. Further, the elongate body can have an s-shaped profile.

BRIEF DESCRIPTION OF THE DRAWINGS

A more complete understanding of the present disclosure, and the attendant advantages and features thereof, will be more readily understood by reference to the following description when considered in conjunction with the accompanying drawings wherein:

FIG. 9 shows rinsing of the hair removal device of FIGS. 1-8.

FIG. 11 shows use of the hair removal device of FIGS. 1-10.

FIG. 12 show a front view of another embodiment of a hair removal device according to the disclosure.

FIG. 13 shows the hair removal device of FIG. 12 with a container.

FIG. 14 shows a side view of the hair removal device of FIG. 12.

FIG. 15 shows a perspective view of the hair removal device of FIG. 12.

FIG. 16 shows another perspective view of the hair removal device of FIG. 12.

DETAILED DESCRIPTION

Figure 1:
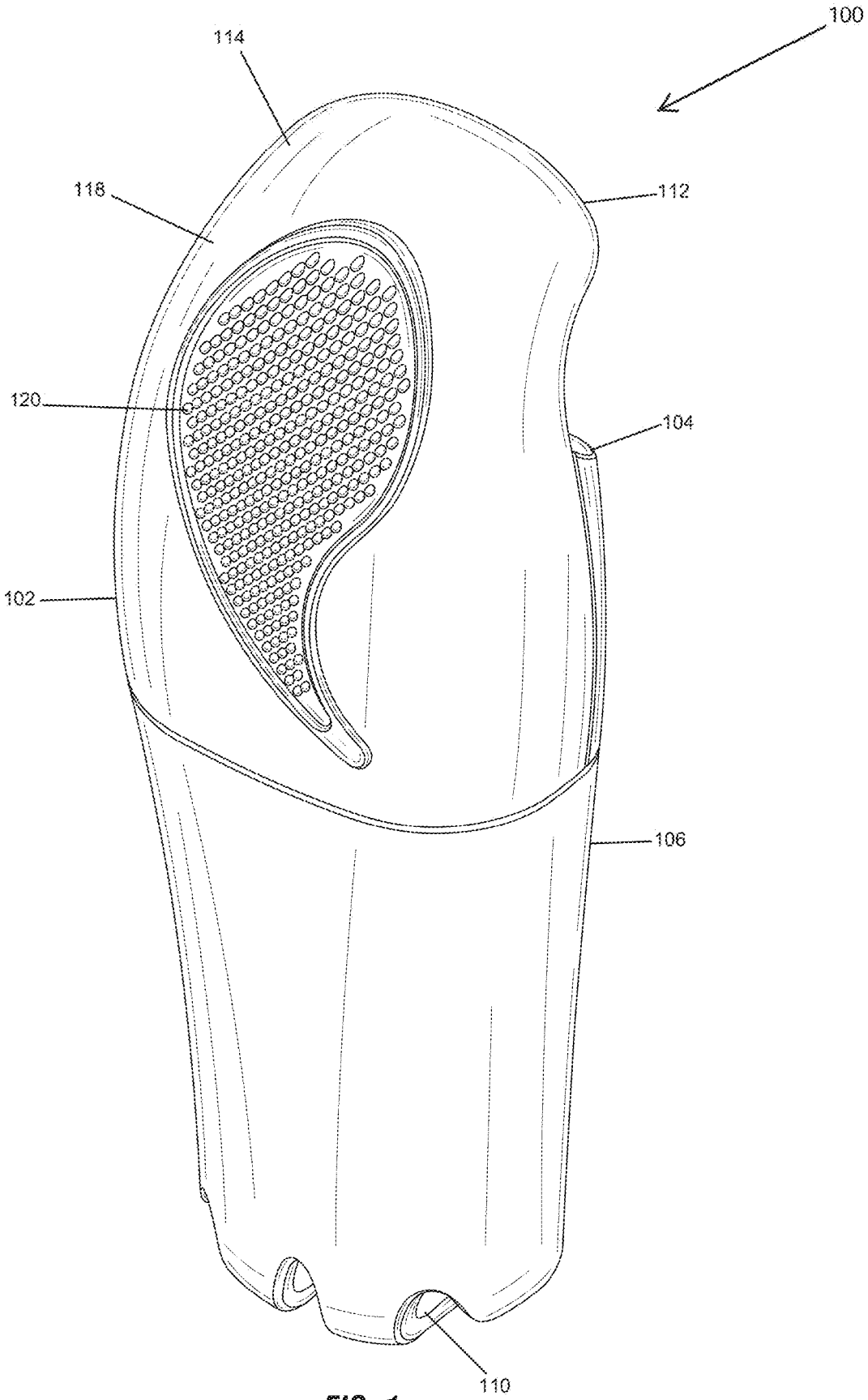
FIG. 1 is a back perspective view a first embodiment of a hair removal device according to the disclosure.
Figure 2:
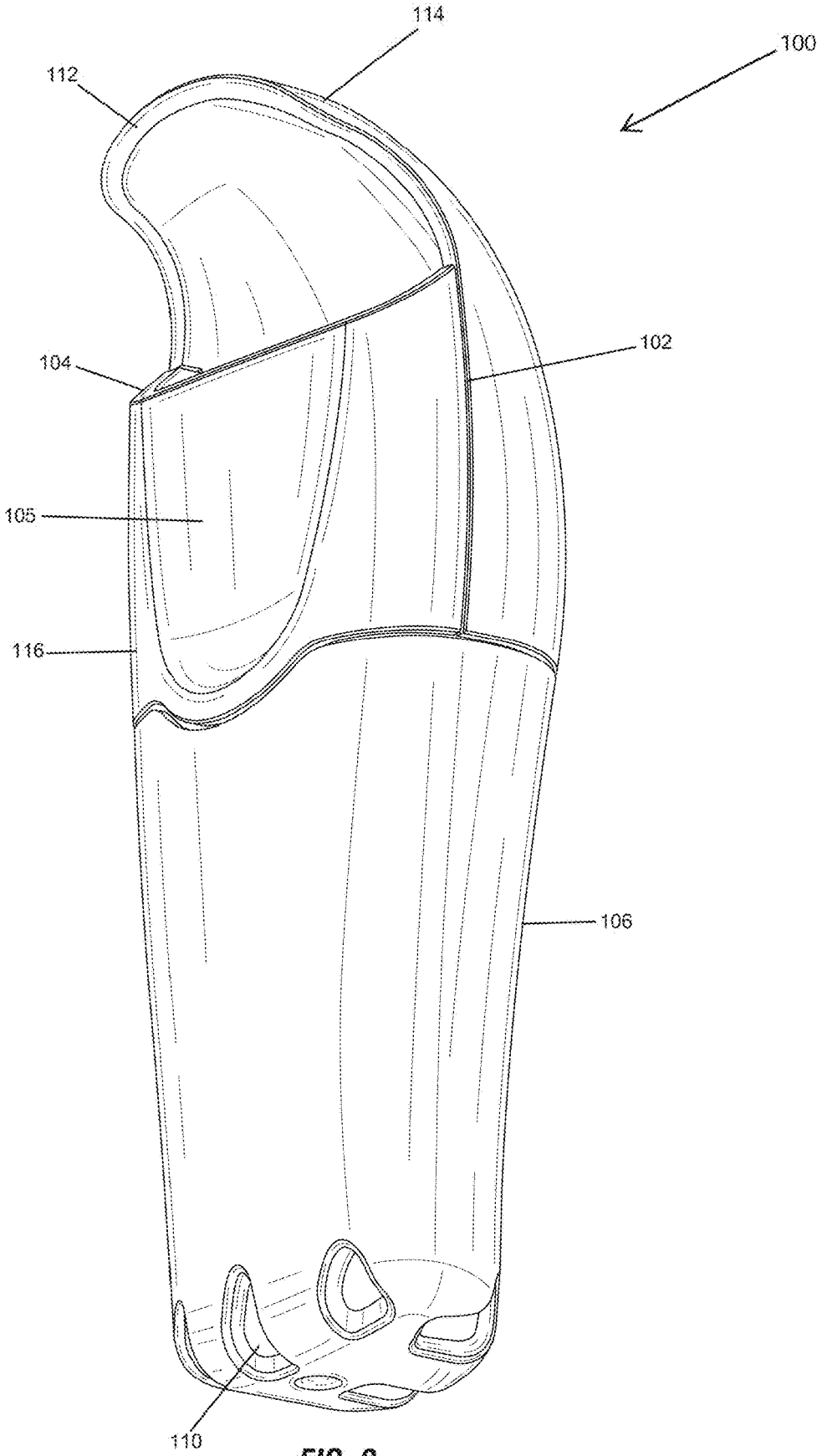
FIG. 2 is a front perspective view of the device of FIG. 1.
Figure 3:
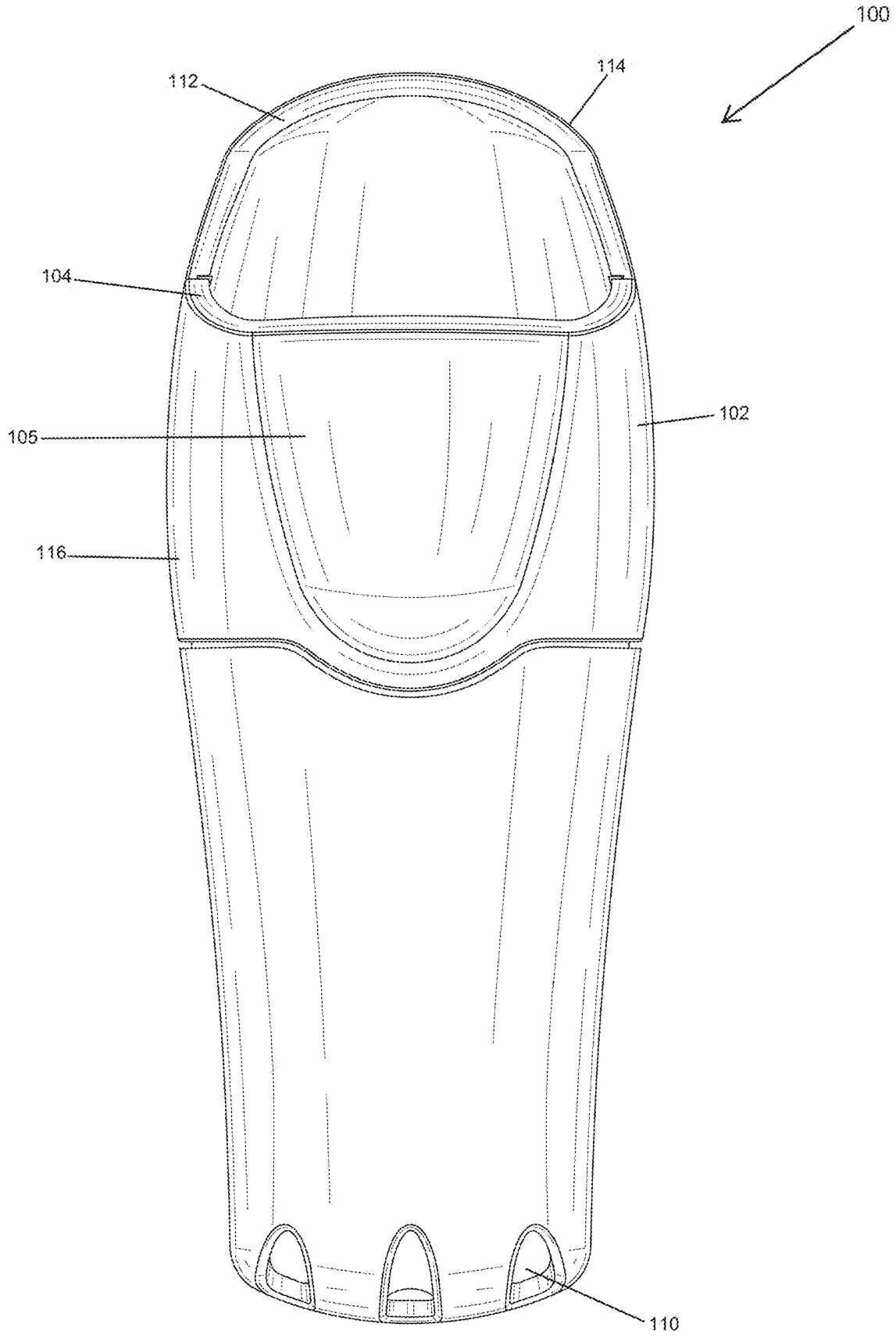
FIG. 3 is a front view of the device of FIG. 1.
Figure 4:
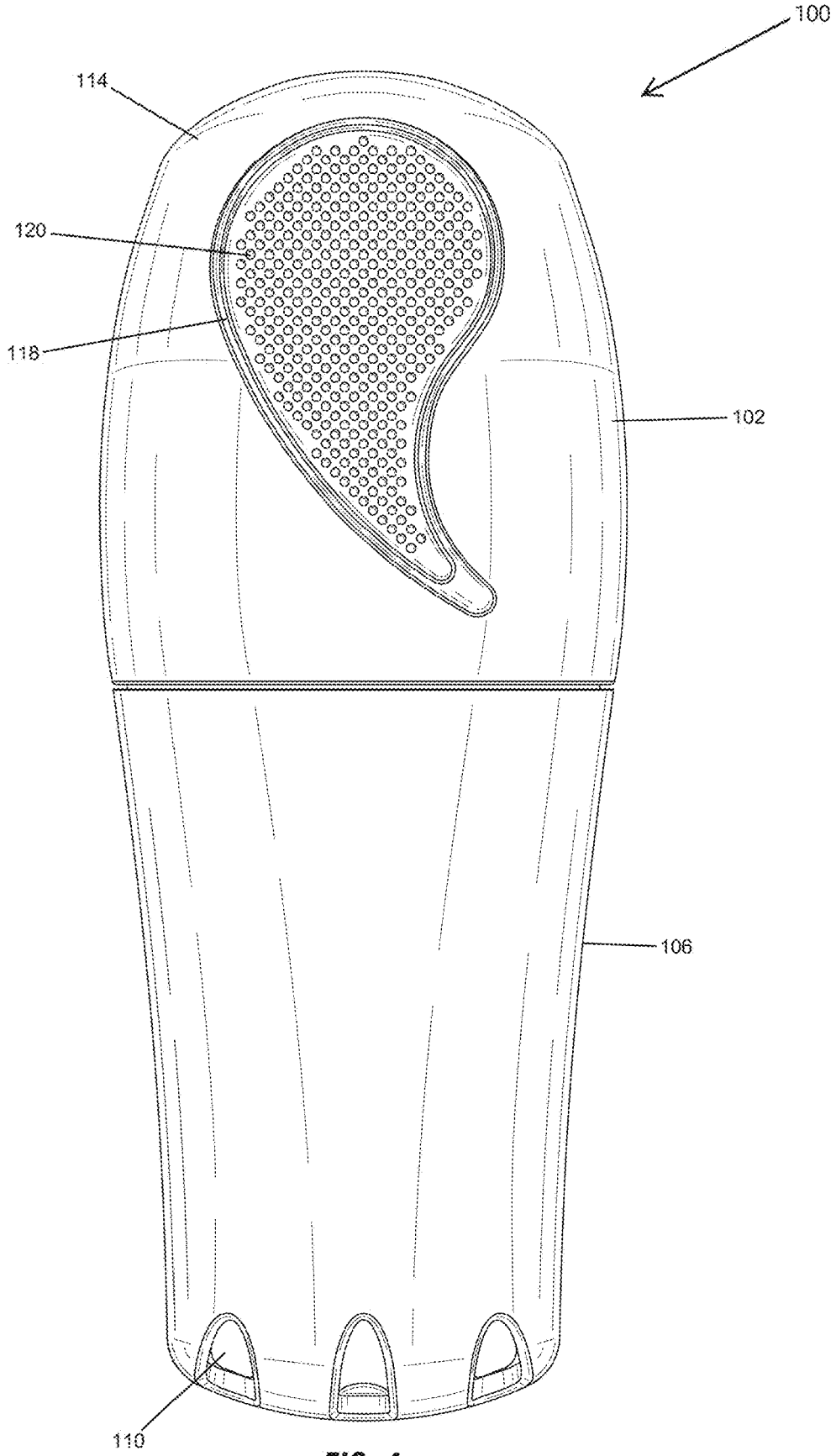
FIG. 4 is a back view of the device of FIG. 1.
Figure 5:
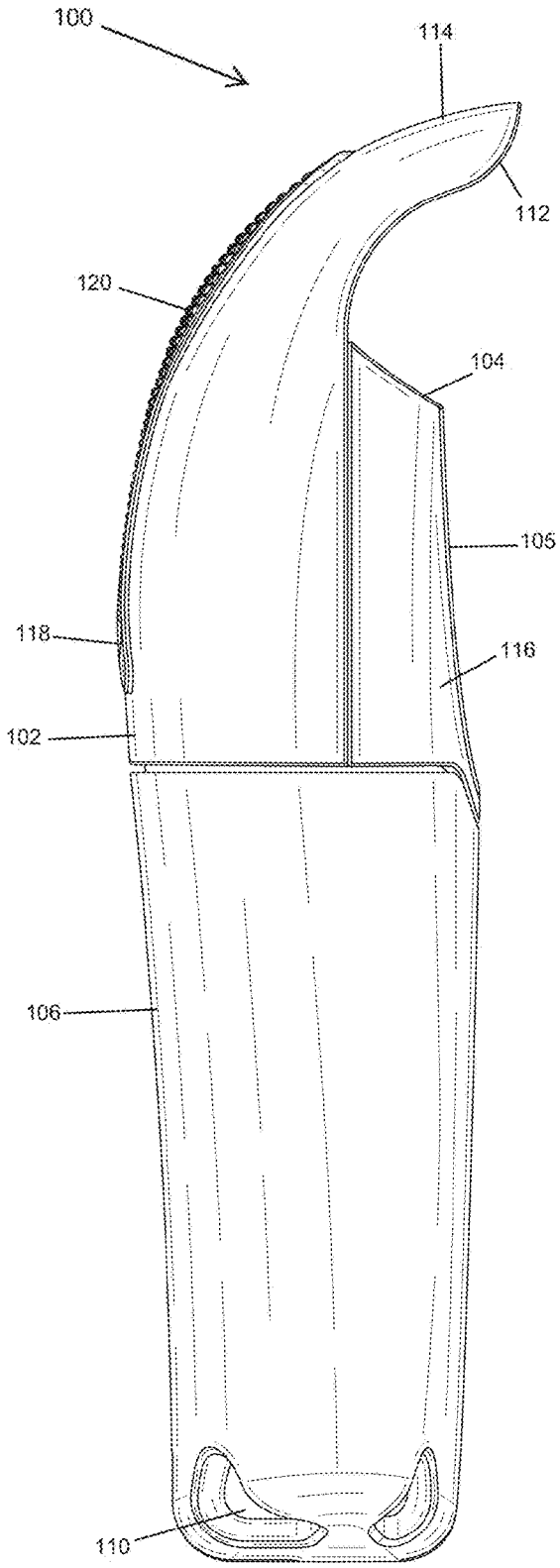
FIG. 5 is a right side view of the device of FIG. 1.
Figure 6:
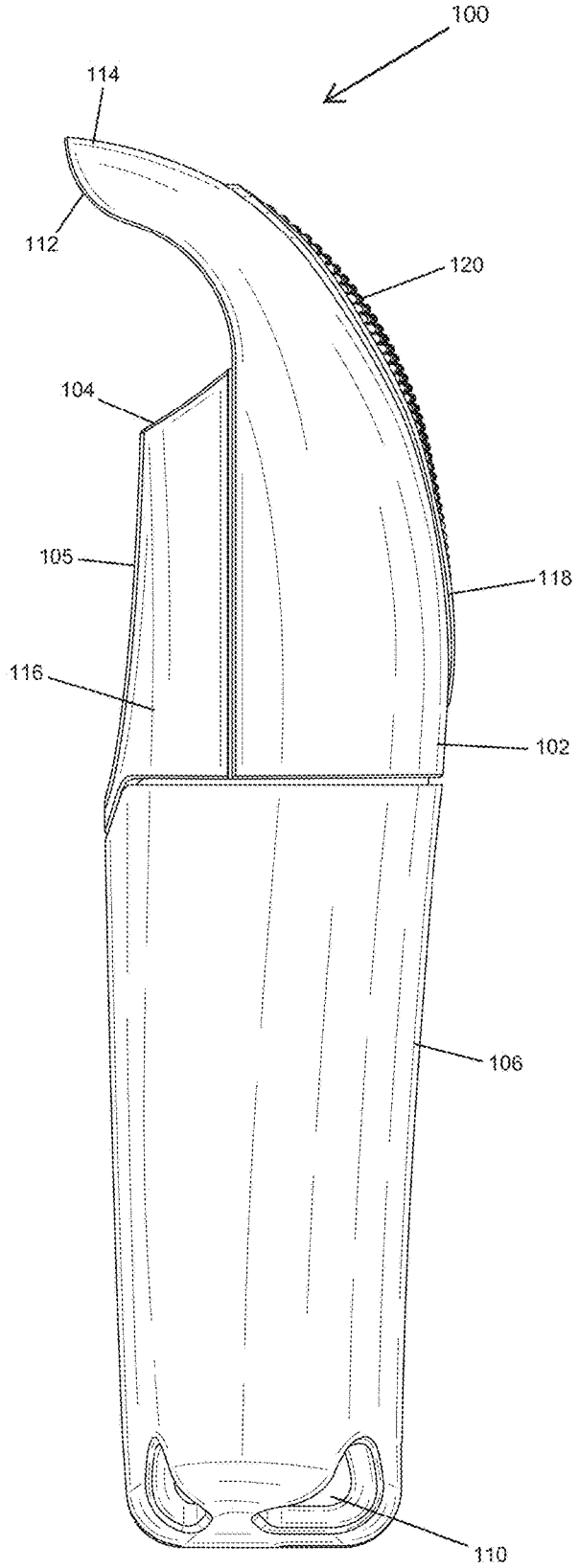
FIG. 6 is a left side view of the device of FIG. 1.
Figure 7:
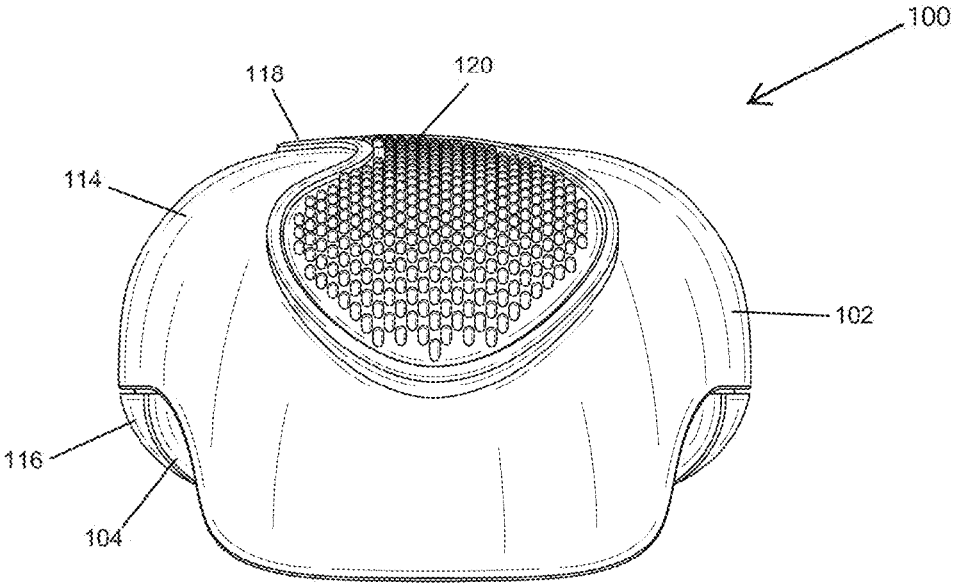
FIG. 7 is a top view of the device of FIG. 1.
Figure 8:
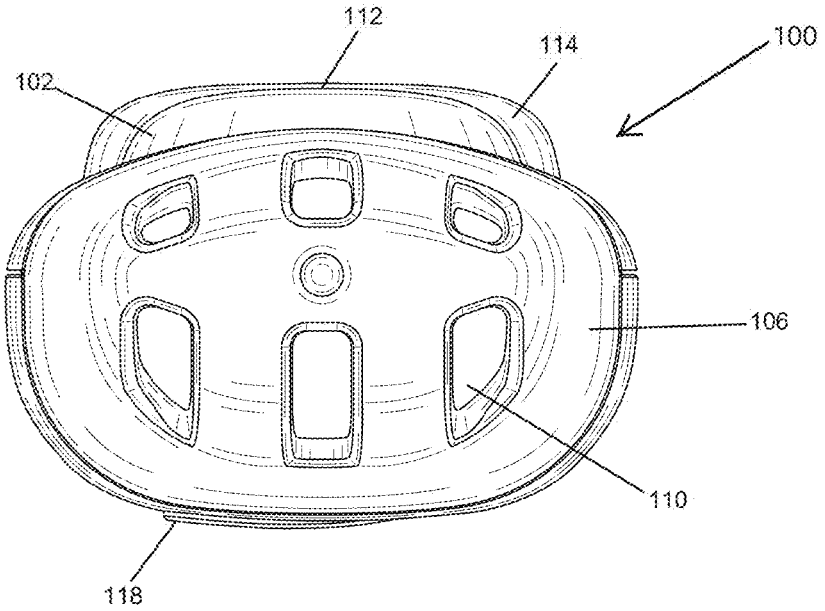
FIG. 8 is a bottom view of the device of FIG. 1.

As required, embodiments are disclosed herein; however, it is to be understood that the disclosed embodiments are merely examples and that the methods described below can be embodied in various forms. Therefore, specific structural and functional details disclosed herein are not to be interpreted as limiting, but merely as a representative basis for teaching one skilled in the art to variously employ the present subject matter in virtually any appropriately detailed structure and function. Further, the terms and phrases used herein are not intended to be limiting, but rather, to provide an understandable description of the concepts.

It can be advantageous to set forth definitions of certain words and phrases used throughout this disclosure. The terms “a” or “an”, as used herein, are employed to describe elements and components described herein. This is done merely for convenience and to give a general sense of the scope of the disclosure. This description should be read to include one or at least one and the singular also includes the plural unless it is obvious that it is meant otherwise. The term plurality, as used herein, is defined as two or more than two. The term another, as used herein, is defined as at least a second or more. The term "coupled," as used herein, is defined as "connected," although not necessarily directly, and not necessarily mechanically.

The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A; B; C; A and B; A and C; B and C; and A, B, and C.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

Note that not all of the activities described above in the general description or the examples are required, that a portion of a specific activity may not be required, and that one or more further activities can be performed in addition to those described. Still further, the order in which activities are listed are not necessarily the order in which they are performed.

In general, the disclosure relates to a hair removal tool or device for removing depilatory cream from any part of the body typically where unwanted hair grows, i.e. face, legs, underarms, arms, intimate areas, chest and back (men), etc. The device can also be used to apply or more uniformly spread the depilatory cream to make the cream more effective prior to removal. The device can also be used for applying and removing any preparation applied to the skin such as skin treatment lotions used as an exfoliating lotion. The following details exemplary embodiments of the tool or device.

Referring to FIGS. 1-11, a first embodiment of a hair removal device 100 according to the disclosure is shown. Hair removal device 100 has a scraper portion 102 provided with an edge 104 for removing hair from skin as edge 104 moves along the skin and scrapes the depilatory cream (FIG. 11). In some embodiments, a surface with a depression 105 can be provided beneath edge 104. Depression 105 can be used to apply or more uniformly spread the depilatory cream (for example by applying less pressure than that used to remove the cream and hair) to make the cream more effective prior to removal.

A receptacle portion 106 is coupled to scraper portion 102 and includes a receptacle 108 for collecting the scraped depilatory cream and removed hair. In this regard, the standard range for viscosity of lotions, skin creams, depilatory creams is about $1.5\times10^5$ to about $5.0\times10^5$ cps so that the scaped depilatory cream and removed hair should fall into receptacle 108.

A unique feature of hair removal device 100 is the facility to collect the cream and removed hair as it is scraped off the skin. As the cream is scraped, it falls or gathers into receptacle 108. As a result, the user does not have to continually wipe collected cream and hair off edge 104 and onto a tissue. The user can continue to use hair removal device 100 without stopping thereby saving time, avoiding any mess, and reducing exposure to chemicals in the cream.

Figure 10:
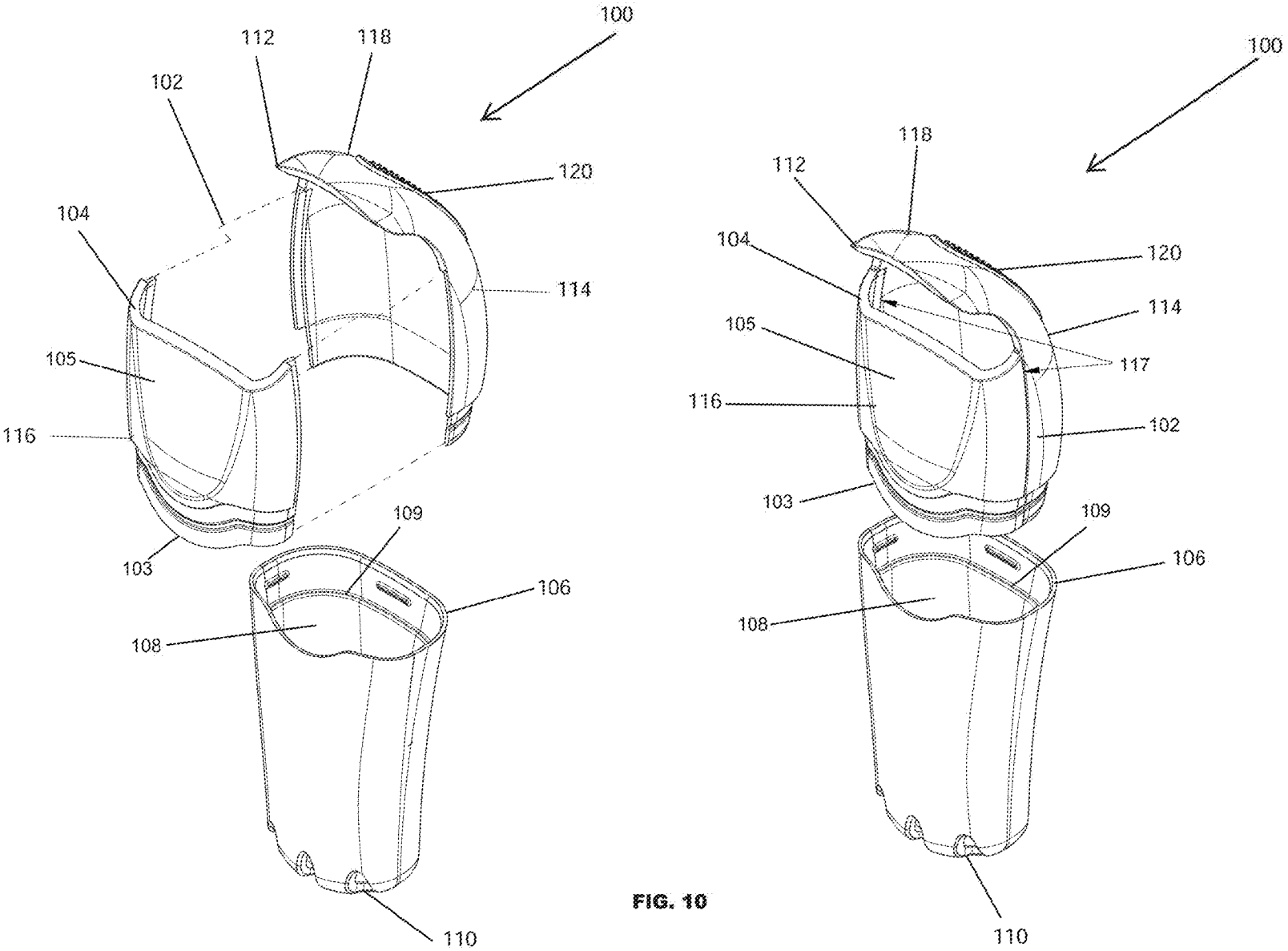
FIG. 10 shows engineering drawings of the hair removal device of FIGS. 1-9.
Figure 17:
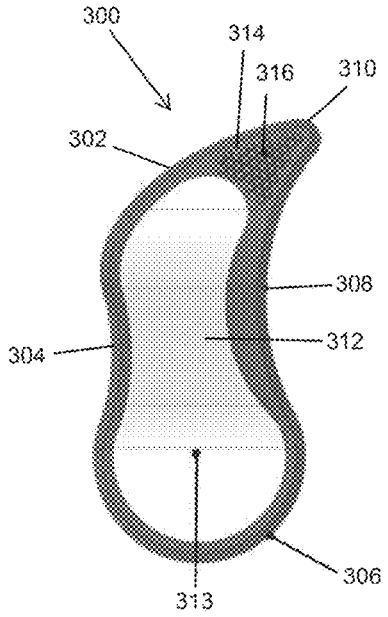
FIG. 17 show a perspective view of another embodiment of a hair removal device according to the disclosure.

As best seen in FIG. 10, receptacle portion 106 is preferably removably coupled to scraper portion 102 to facilitate cleaning of hair removal device 100. Although FIG. 10 shows a press fit as the mechanism for removably coupling, the disclosure contemplates any other suitable mechanism can be used (e.g. a hinge, swivel movement, collecting bag, etc.). The disclosure also contemplates that receptacle portion 106 is not removably coupled to scraper portion 102.

Receptacle 108 can be provided with a rim 109 on which a bottom 103 of scraper portion 102 rests when scraper portion 102 is inserted into receptacle portion 106. This helps to provide mechanical stability to hair removal device 100 in use as force is applied to the skin to prevent unintended separation of scraper portion 102 from receptacle portion 106.

Regardless of whether receptacle portion 106 is removably coupled to scraper portion 102 or not, the collected cream and removed hair can be rinsed or washed from receptacle 108. In this regard, receptacle 108 can include flush vents 110 to drain the rinsing water or any other suitable fluid along with the collected cream and removed hair (FIG. 9). As an alternative or addition to flush vents 110, receptacle 108 can include a trap door device to flush away the cream and removed hair.

Depending on the application (i.e. the body part), edge 104 is configured and dimensioned to conform to arm and/or leg contours. Further, scraper portion 102 can include a secondary edge 112 configured and dimensioned to conform to facial contours. In a preferred embodiment, edge 104 is substantially concave and secondary edge 112 is substantially convex. As one of ordinary skill in the art will appreciate, the shapes and sizes of edge 104 and secondary edge 112 can be varied depending on the application.

Referring again to FIG. 10 in particular, scraper portion 102 includes a top section 114 with secondary edge 112 and a front portion 116 with edge 104 and depression 105. In a preferred manufacturing method, top section 114 and front portion 116 are ultrasonically welded together. However, the disclosure contemplates that top section 114 and front portion 116 are removably coupled. The disclosure also contemplates that top section 114 and front portion 116 are manufactured as unitary single piece.

Hair removal device 100 can also be used for removing other skin treatment lotions such as exfoliating cream. In this regard, hair removal device 100 has a back surface 118 with an exfoliator feature 120, such as a plurality of bumps or protrusions. Bumps or protrusions can be configured, dimensioned and arranged to suit a particular application. Non-limited exemplary dimensions of the bumps and protrusions are approximately 0.7 mm in diameter and 0.7 mm in length in an array with suitable separation (e.g. 0.1 mm to 2 mm).

FIGS. 12-16 show a second embodiment of a hair removal device 200 according to the disclosure. Hair removal device 200 has a scraper portion 202 provided with an edge 204 for removing hair from skin as edge 204 moves along the skin and scrapes the depilatory cream. In some embodiments, a surface with a depression 205 can be provided beneath edge 204. Depression 205 can be used to apply or more uniformly spread the depilatory cream (for example by applying less pressure than that used to remove the cream and hair) to make the cream more effective prior to removal.

A receptacle portion 206 includes a receptacle 208 for collecting the scraped depilatory cream and removed hair. If desired, receptacle 208 can provide a convenient storage location for a container such as a tube of depilatory cream. A contour 209 on receptacle portion 206 can provide a locate for a user's finger to grip. Like hair removal device 100, hair removal device 200 collects the cream and removed hair as it is scraped off the skin. As the cream is scraped, it falls or gathers into receptacle 208. The collected cream and removed hair can be rinsed or washed from receptacle 208. In this regard, receptacle 208 can include flush vents 210 to drain the rinsing water or any other suitable fluid along with the collected cream and removed hair. As an alternative or addition to flush vents 210, receptacle 208 can include a trap door device to flush away the cream and removed hair.

Depending on the application (i.e. the body part), edge 204 is configured and dimensioned to conform to arm and/or leg contours. However, hair removal device 200 can also be used for applying and removing depilatory cream from the face. In a preferred embodiment, edge 204 is substantially concave. As one of ordinary skill in the art will appreciate, the shape and size of edge 204 can be varied depending on the application. Hair removal device 200 can also be used for applying and/or removing other skin treatment lotions such as exfoliating cream.

FIGS. 17-20 show a third embodiment of a hair removal device 300 according to the disclosure. Unlike hair removal device 100 and hair removal device 200, hair removal device 300 does not include a receptacle. Like hair removal device 100 and hair removal device 200, hair removal device 300 can be used for applying and removing depilatory cream (as well as other lotions and creams) to and from the face any different parts of the body.

In this regard, hair removal device 300 is an elongate body, the entire outer surface of which is a series of curved surfaces for removing hair from skin as the outer surface moves along the skin and scrapes the depilatory cream. The variety of curves allows the outer surface to follow the contours of facial and body areas where hair removal takes place. As shown, the outer surface includes a large convex scraper 302, small concave scraper 304, small convex scraper 306, large concave scraper 308, and a detail scraper 310. As one of ordinary skill in the art will appreciate, the shapes and sizes of scrapers 302, 304, 306, 308, 310 can be varied depending on the application.

Figure 18:
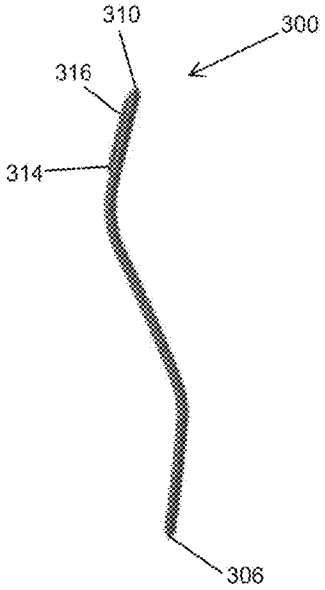
FIG. 18 shows a side view of the hair removal device of FIG. 17.
Figure 19:
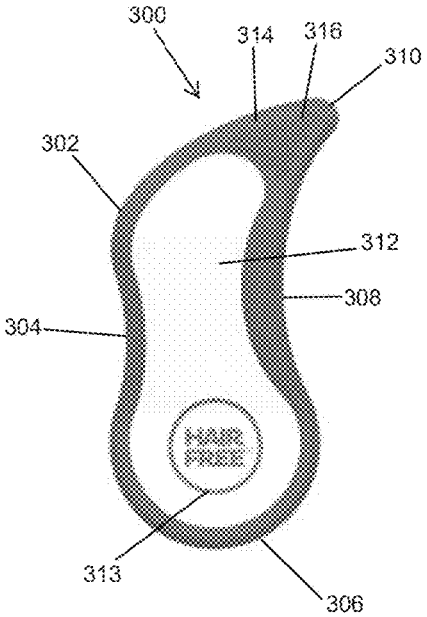
FIG. 19 shows a front view of the hair removal device of FIG. 17.
Figure 20:
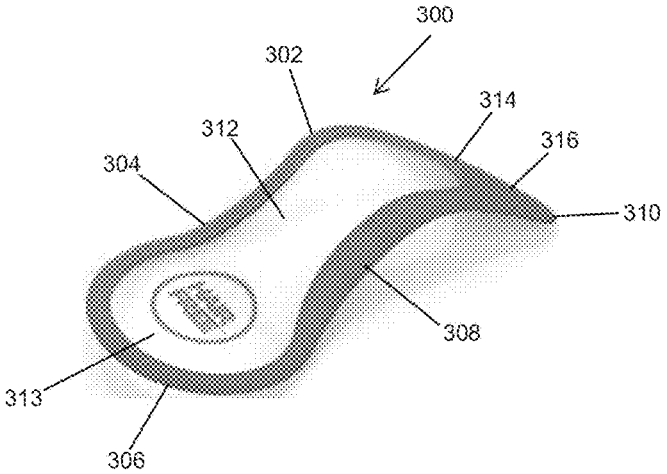
FIG. 20 shows another perspective view of the hair removal device of FIG. 17.

Inside the outer surface, a central portion 312 can be transparent or translucent to allow the user to visualize the skin. The size, shape, and/or location of central portion 312 can be varied. Central portion 312 includes an area 313 for a user's hand to grip hair removal device 300. As best seen in FIG. 18, the side profile of hair removal device 300 is S-shaped to improve structural stability.

As previously noted, hair removal device 300 can also be used for applying and/or removing other skin treatment lotions such as exfoliating cream. In this regard, hair removal device 300 has a surface 314 with an exfoliator feature 316, such as a plurality of bumps or protrusions. Bumps or protrusions can be configured, dimensioned and arranged to suit a particular application. Non-limited exemplary dimensions of the bumps and protrusions are approximately 0.7 mm in diameter and 0.7 mm in length in an array with suitable separation (e.g. 0.1 mm to 2 mm).

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the disclosure, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

The invention claimed is:

1. A hair removal device for use with a depilatory cream, the device comprising:

a scraper portion having an edge for removing hair from skin as the edge moves along the skin and scrapes the depilatory cream; and a receptacle portion coupled to the scraper portion and having a receptacle for collecting the scraped depilatory cream and removed hair, wherein the receptacle portion includes flush vents so that the collected depilatory cream and removed hair can be rinsed from the receptacle portion through the flush vents.

2. The device of claim 1, wherein the receptacle portion is removably coupled to the scraper portion.

3. The device of claim 1, wherein the scraper portion includes a secondary edge configured and dimensioned to conform to facial contours and wherein the edge is configured and dimensioned to conform to arm and/or leg contours.

4. The device of claim 3, wherein the scraper portion includes a top section with the secondary edge and a front portion with the edge.

5. The device of claim 4, wherein the secondary edge is convex and the edge is concave.

6. The device of claim 1, wherein the device has a back surface with an exfoliator feature.

7. The device of claim 6, wherein the exfoliator feature is a plurality of bumps.

8. The device of claim 1, wherein the receptacle portion is removably coupled to the scraper portion and wherein the receptacle includes a rim on which a bottom of the scraper portion rests when the scraper portion is inserted into the receptacle portion.

9. A hair removal device for use with a depilatory cream, the device comprising:

a scraper portion having an edge for removing hair from skin as the edge moves along the skin and scrapes the depilatory cream; and a receptacle portion coupled to the scraper portion and having a receptacle for collecting the scraped depilatory cream and removed hair, wherein the receptacle portion is removably coupled to the scraper portion, wherein the receptacle portion includes flush vents so that the collected depilatory cream and removed hair can be rinsed from the receptacle portion through the flush vents, and wherein the scraper portion includes a secondary edge configured and dimensioned to conform to facial contours and wherein the edge is configured and dimensioned to conform to arm and/or leg contours.

10. The device of claim 9, wherein the scraper portion includes a top section with the secondary edge and a front portion with the edge.

11. The device of claim 10, wherein the secondary edge is convex and the edge is concave.

12. The device of claim 11, wherein the device has a back surface with an exfoliator feature.

13. The device of claim 12, wherein the exfoliator feature is a plurality of bumps.

14. The device of claim 9, wherein the receptacle includes a rim on which a bottom of the scraper portion rests when the scraper portion is inserted into the receptacle portion.

* * * * *